US007784324B2

(12) United States Patent
Dangelmayr

(10) Patent No.: US 7,784,324 B2
(45) Date of Patent: Aug. 31, 2010

(54) WORKPIECE GRIPPER ARRANGEMENT FOR AUTOMATIC TOOL CHANGE OPERATIONS

(75) Inventor: Andreas Dangelmayr, Ottenbach (DE)

(73) Assignee: Schuler Pressen GmbH Co. KG, Göppingen (DE)

( * ) Notice: Subject to any disclaimer, the term of this patent is extended or adjusted under 35 U.S.C. 154(b) by 466 days.

(21) Appl. No.: 11/804,638

(22) Filed: May 19, 2007

(65) Prior Publication Data

US 2007/0277582 A1 Dec. 6, 2007

(30) Foreign Application Priority Data

May 31, 2006 (DE) ..... 10 2006 025 272

(51) Int. Cl.
*B21J 11/00* (2006.01)
*B21D 43/05* (2006.01)

(52) U.S. Cl. ..... 72/405.13; 72/422

(58) Field of Classification Search ..... 72/405.01, 72/405.13, 422, 482.92; 414/751.1, 752.1
See application file for complete search history.

(56) References Cited

U.S. PATENT DOCUMENTS 5,071,309 A * 12/1991 Herbermann ..... 414/680
5,473,927 A * 12/1995 Brandstetter et al. ..... 72/405.14
5,782,129 A * 7/1998 Vanderzee et al. ..... 72/405.1
5,842,370 A * 12/1998 Hofele et al. ..... 72/405.09
6,244,814 B1 * 6/2001 Herbermann et al. .... 414/752.1
7,128,198 B2 * 10/2006 Yoshida et al. ..... 198/468.4
2002/0088266 A1 * 7/2002 Hofele et al. ..... 72/405.01
2003/0051980 A1 3/2003 Sofy
2006/0078413 A1 * 4/2006 Hurst et al. ..... 414/752.1

FOREIGN PATENT DOCUMENTS

DE 36 34 756 A1 6/1987
DE 38 36 715 A1 7/1989
DE 43 24 619 A1 1/1995
DE 4324619 A1 * 1/1995
DE EP 08 78 251 A1 11/1998
DE EP 09 01 848 A1 3/1999
DE EP 1 366 834 A1 12/2003
DE 10 2004 052001 A 4/2006

OTHER PUBLICATIONS

Derwent Abstract of DE4324619A1.*

* cited by examiner

*Primary Examiner*—Dana Ross
*Assistant Examiner*—Mohammad Yusuf
(74) *Attorney, Agent, or Firm*—R. S. Lombard; K. Bach

(57) ABSTRACT

A workpiece gripper arrangement for the automatization of presses, including a transfer arrangement for transferring components between workstations, the transfer arrangement includes a girder or carrier with gripper means for holding the components and the gripper means is supported via coupling parts of which one is connected to the girder and the other to the gripper means and a mechanical locking structure is provided which is operable by relative movement of the coupling arrangement with respect to a support frame on which the gripper means can be deposited.

2 Claims, 4 Drawing Sheets

WORKPIECE GRIPPER ARRANGEMENT FOR AUTOMATIC TOOL CHANGE OPERATIONS

CROSS-REFERENCE TO RELATED APPLICATION

This application claims the priority benefits of German Application No. 10 2006 025 272.1 filed May 31, 2006.

BACKGROUND OF THE INVENTION

The invention relates to a tool gripper arrangement provided for the automatization of processes particularly for large compartment stage presses. The workpiece gripper arrangement is particularly suitable for an automatic tool change.

"Tooling" in a press, particularly a large compartment stage press such as a vehicle body press, are the elements adapted specifically to the metal sheets or other organs of the press such as the gripper arrangements. The gripper arrangements are used, for example, for the transfer of metal sheets from one press to the next and for placing the metal sheet parts into the respective press stage and the removal thereof, from the respective press stage. The gripper arrangements may be, for example, suction arms or similar devices. The suction arms comprise several suction cups which are supported by several arms of a support frame. The suction cups are adapted in shape to the contour of the metal sheet parts. The suction arms are moved by a drive arrangement, for example, a transfer device. The transfer device includes various support beams which extend transverse to the transport direction, so called girders on which the tooling, that is the gripper means in the form of a frame from which the arms with the suction sups extend are supported. During a tool change, generally also, the tooling needs to be changed.

It is the object of the present invention to provide a workpiece gripper arrangement wherein a tool change can be performed automatically in a simple manner.

SUMMARY OF THE INVENTION

The present invention provides a workpiece gripper arrangement for the automatization of presses, including a transfer arrangement for transferring components between workstations, the transfer arrangement includes a girder or carrier with gripper means for holding the components and the gripper means is supported via coupling parts of which one is connected to the girder and the other to the gripper means and a mechanical locking structure is provided which is operable by relative movement of the coupling arrangement with respect to a support frame on which the gripper means can be deposited.

The workpiece gripper arrangement includes gripping means, for example, in the form of a suction spider and a girder or carrier, for example, in the form of a support beam wherein the carrier is connected to the gripper means via a coupling arrangement. The coupling arrangement comprises a mechanical locking structure which can be locked or unlocked by an operator. The operator can be activated by a relative movement of the coupling arrangement against a stop wherein the relative movement causes a release of the locking structure when the operator is activated by the relative movement.

With this arrangement, movements of the carrier provided by the drive arrangement can be used for the coupling and uncoupling of the coupling arrangement. The drive arrangement is present in any case, in order to move the carrier and, together therewith the gripper means to the workpiece. The drive arrangement is preferably such that the carrier is movable in various spatial directions including along its longitudinal axis and transverse thereto. The movement in the transverse direction can be utilized for the actuation of this operator if a stop is engaged thereby. The movement in the longitudinal direction can be altered for the coupling or uncoupling of the gripper means that is for the opening and closing of the coupling structure.

With the proposed solution, it is consequently possible to utilize for the automatic tool exchange the axes of the transfer arrangement. Active couplings or active locking devices with corresponding remotely controlled actuators are not required. The fact that no drive means are needed for the coupling arrangement reduces the weight of the coupling arrangement whereby the dynamics of the transfer arrangement can be improved.

The coupling arrangement, particularly the carrier-side coupling part, may be slidably supported on this carrier by means of a linear guide structure. The coupling arrangement may be provided with a drive device for the movement of the gripper arrangement in the longitudinal direction of the carrier. In this way, driving the transport of the metal sheets, the metal sheets or other workpieces can be adjusted in the longitudinal direction of the carrier. Furthermore, the linear guide arrangement can be utilized in connection with a drive arrangement to execute the coupling movement.

Preferably, the coupling part associated with the gripper arrangement includes an arresting structure by which the gripper arrangement can be deposited in a storage structure, for example, a support frame or a storage cart. The arresting structure is preferably activated by a relative movement between the gripper arrangement and the storage structure. The relative movement in that case is, for example, transverse to the longitudinal carrier, for example, in a vertical direction. In a simple embodiment the arresting structure is framed by indexing bolts which are provided on the support frame and which are capable of moving into corresponding openings in the coupling part associated with the gripper arrangement.

The coupling arrangement is formed preferably by coupling parts which engage each other wherein one coupling part includes one or several fingers which extend parallel to the carrier that is in the direction of the coupling or uncoupling movement. The fingers or other longitudinal projections are received in recesses in the other coupling port. The recesses again are provided with locking members which are part of the arresting structure, for example, in the form of locking bolts which can extend into openings in the fingers. The locking bolts lock the fingers in the respective associated recesses when they extend into the openings in the respective fingers.

The locking bolts can be operated by an actuating pin section forming the operating structure. The locking bolts and, consequently, the operating structure are oriented in a direction transverse to the carrier and consequently, transverse to the coupling and uncoupling arrangement. When the operating structure abuts a stop and the carrier is moved together with the coupling arrangement in a transverse direction, the operating structure and, as a result, the locking bolt is moved to the release position. In this way, the locking can be engaged with, or disengaged, from the carrier supply by an approximate control of the drive means for the transfer arrangement.

Advantageous embodiments of the invention will be described below with reference to the accompanying drawings.

DESCRIPTION OF PREFERRED EMBODIMENTS

Figure 1:
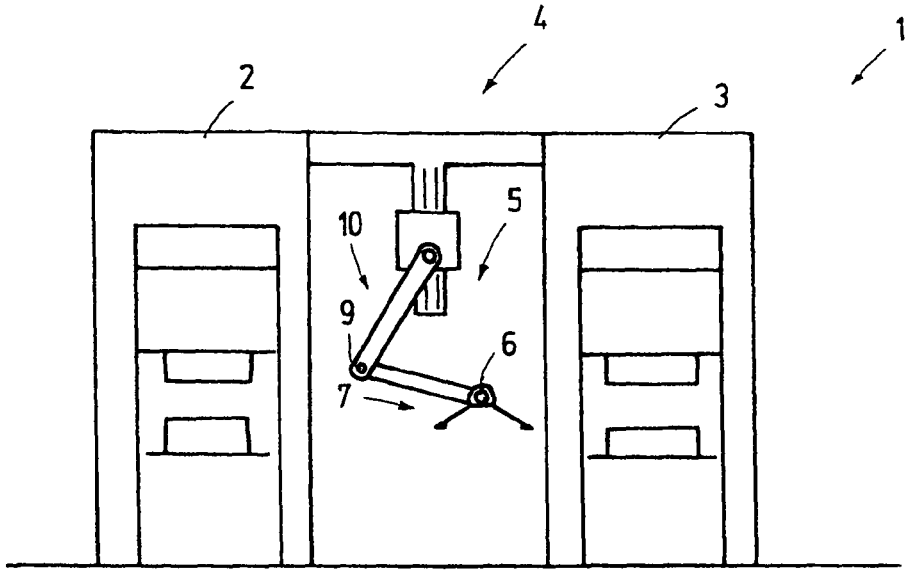
FIG. 1 shows schematically presses with a transfer unit.
Figure 2:
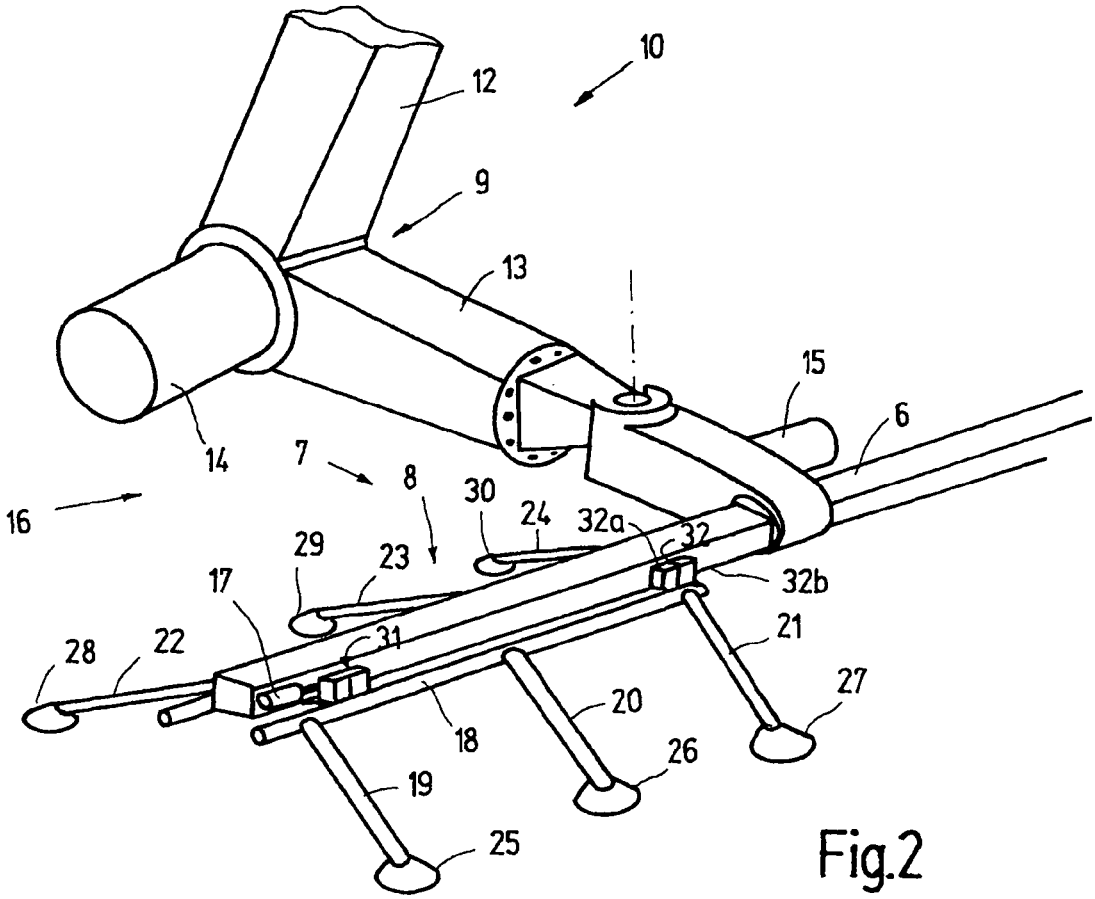
FIG. 2 is a prospective view of the transfer unit according to FIG. 1 with a transverse carrier and tooling.

FIG. 1 is a highly schematic representation of a press installation 1 including two presses 2, 3 and a transfer arrangement 4 including a transfer unit 5. The transfer unit 5 is provided for transferring workpieces, for example, sheet metal parts, particularly large sheet metal parts, such as, motor vehicle body parts, from the press 2 to the press 3 or to an interim storage location which is not shown herein. The press installation 1 may comprise a single press, two presses as shown in FIG. 1 or several presses. The transfer arrangement 4 may comprise one or several transfer units 5. The transfer arrangement is adapted to move one or several girders 6 which form a carrier for a gripper means 7. The gripper means 7 may comprise, for example, several suction spiders 8 as shown in FIG. 2. The transfer unit 5 as shown herein includes a support arm 10 having arm sections 12, 13 joined by a joint 9. For a controllable movement of the arm sections 12, 13, drives 14, 15 are provided and also other drives which are not shown so that the guider 6 can be moved in horizontal and vertical directions as desired and can also pivoted in selected directions. The drives 14, 15 form, together with the other drives which are not shown, a drive arrangement 16. The drive arrangement 16 may additionally include an adjustment drive structure 17 by which the suction spider 8 is movable longitudinally along the girder 6. The adjustment drive structure 17 is optional. It may be omitted in particular in connection with transfer units which permit a movement of the guider 6 on a horizontal transverse direction that is in the longitudinal direction of the girder 6.

The suction spider 8 comprises a frame 18 including two support tubes extending parallel to the girder 6. From the support tubes, tubular arms (19, 20, 21, 22, 23, 24) extend, which each carry a suction cup (25, 26, 27, 28, 29, 30). The suction cups are, for example, in the form of downwardly open dished rubber elements which can be evacuated via the tubular arms 19 to 24.

For depositing the suction spider 8 on the girder 6, a coupling arrangement 31 is provided at one end of the frame 18. Another coupling arrangement may be provided at the other end or there may be a connecting structure 32 which comprises two parts 32*a*, 32*b*, which engage each other in a form-locking manner or are disengaged by relative movement in axial direction along the girder 6.

The coupling arrangement 31 is suitable particularly for depositing the tooling in the form of the suction spider 8 on a passive support frame with the aid of movements provided by the transfer unit 5 of the girder 6 by the drive arrangement 16 which are present anyway, and which are provided to position the girder 6 in the space for the transport of the workpiece.

Figure 3:
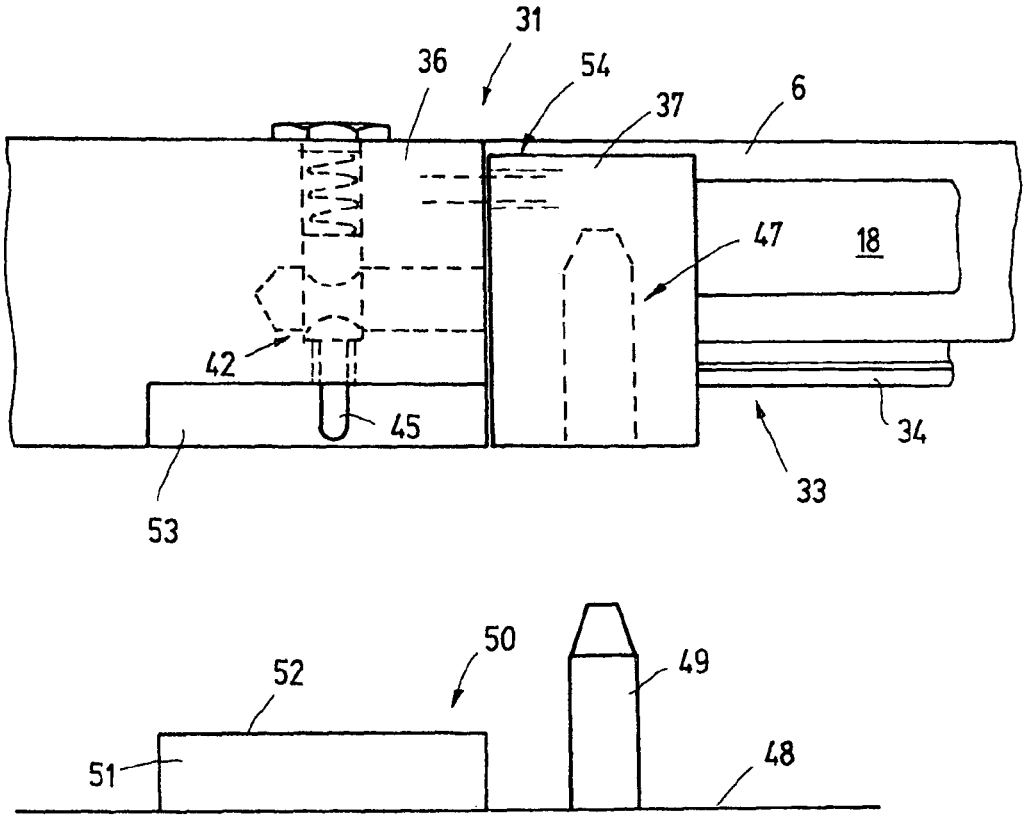
FIG. 3 shows schematically part of a coupling arrangement of the transfer arrangement according to FIG. 2 together with an associated storage structure.
Figure 4:
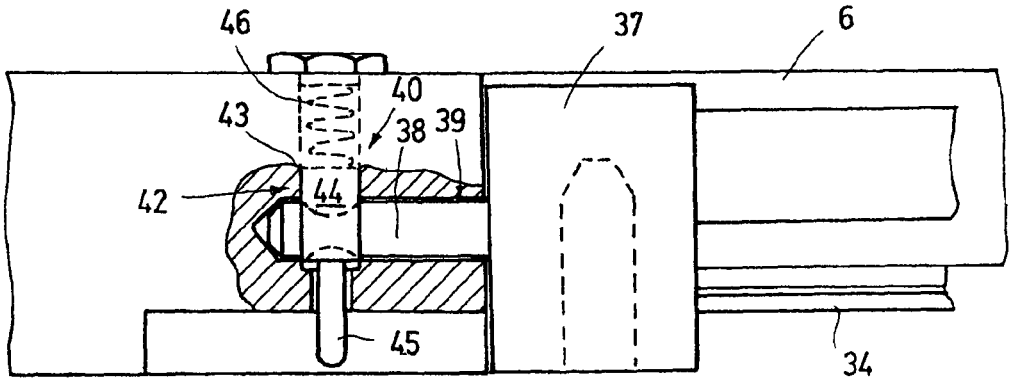
FIG. 4 shows the coupling arrangement according to FIG. 3 in a partially sectional side view.

FIG. 3 shows the coupling arrangement 31 on the girder 6. Below the girder 6, there is a linear guide structure 33 via which the coupling arrangement 31 can be moved longitudinally along the girder 6. Part of the linear guide structure 33 is a guide track 34 which is oriented parallel to the girder and supported thereby and on which a carriage is movably supported. The coupling arrangement 31 comprises a first coupling part 36 which is connected to the carriage moveably supported on the guide track 34 or directly to the girder 6, and a second coupling part 37 which carries the frame 18. As shown in FIG. 4, a pin 38 extends from the coupling part 37 parallel to the girder track 34 or to the girder 6 into a bore or other opening 39 with little play. The pin 38 is in engagement with a locking structure 40. For locking the pin 38 including, at its end, a recess, for example, in the form of a groove 41 which may extend around the pin 38. A locking bolt 42, which is part of the locking arrangement, is slidably supported in another bore 43 which extends transversely to the other opening 39. The opening 39 intersects the bore 43 at an angle of about 90 degrees and outside the center thereof. While the opening 39 extends preferably parallel to the girder 6 the bore 43 extends in transverse direction thereto, preferably vertically.

Figure 5:
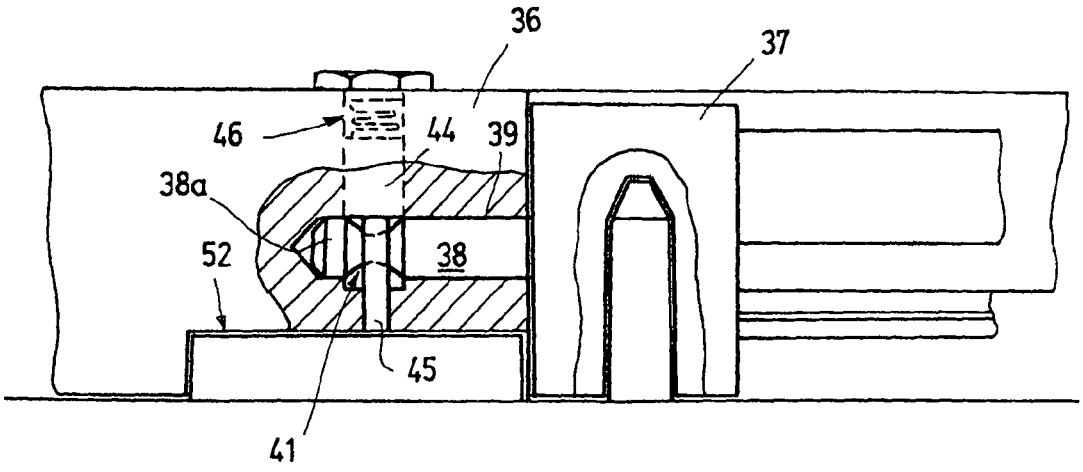
FIG. 5 shows the coupling arrangement according to FIGS. 3 and 4 deposited on the storage structure with locking structure unlocked.
Figure 6:
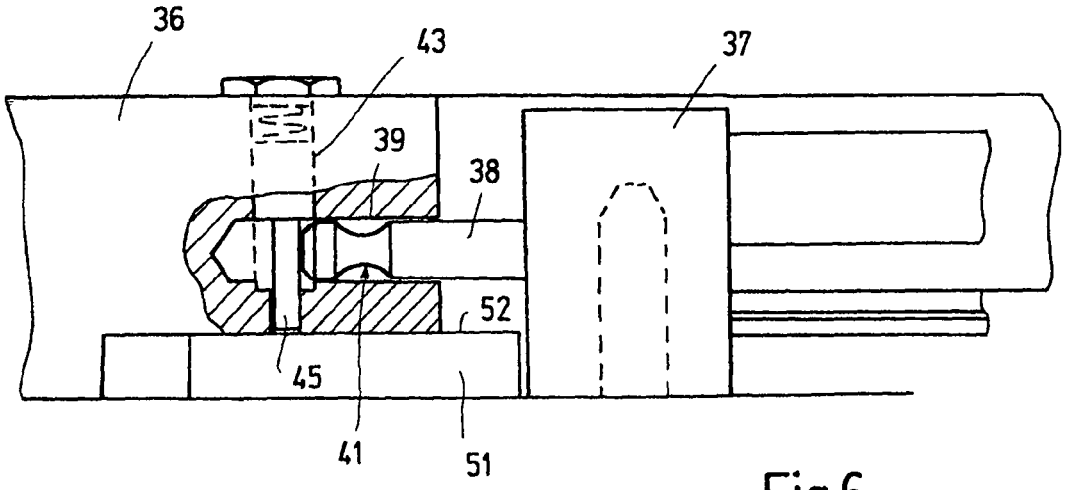
FIG. 6 shows the coupling arrangement according to FIG. 5 during unlocking.

The locking bolt 42 includes a blocking section 44, whose diameter corresponds to the diameter of the bore 43 and to the curvature of the groove 41. From the blocking section 44 an operating pin section 45 extends axially with a diameter which is so small that the operating pin does not pass through the bore when, as shown in FIGS. 5 and 6, it is in an upper position. The operating pin section 45 forms an operating member by way of which the coupling arrangement 31 can be released from the locked position into a release position in which the coupling parts are released from each other.

The locking bolt 42 is biased by spring 46 disposed in the bore 43 or by another suitable means into its locking position in which the blocking section 44 intersects the bore 39.

The coupling part 37 includes an indexing bore 47 which extends parallel to the bore 43 that is transverse to the girder 6 the indexing bore 47 is adapted to receive an indexing bolt 49 which projects from a support frame 48 preferably vertically upwardly. The coupling part 37 may be provided on each side of the girder 6 with a corresponding indexing bore and a corresponding number of indexing bolts may be provided in appropriate positions for reception in the indexing bores.

In addition to the indexing bolt 49, a stop 50 is provided, in the form of a release plate 51 which has a flat top surface 52 extending in a direction transverse to the indexing bolt 49. This surface 52 may be a plane surface. It extends preferably parallel to the pin 38. The unlocking plate can be received in a recess 53 formed in the bottom area of the coupling part 36 and adapted to receive the release plate 51. The operating pin section 45 of the locking bolt 42 extends into the recess 53, but not beyond the recess 53 as shown in FIGS. 3 and 4.

The transfer unit 5 described herein operates as follows with regard to a tool change:

it is assumed, as indicated in FIG. 2, that first a suction spider 8 which is supported on the girder 6 is to be exchanged. The support arm 10 moves the girder 6 over a support frame 48, as shown in FIG. 3, and lowers the girder 6. As a result, the coupling part 37 is disposed onto the indexing bolt 49 which moves into the indexing bore 47. The pin operating sections 45 in the process abuts the surface 52 of the release plate 51 and is moved relative to the coupling part 36 against the force of this spring 46 to its release position. This state is shown in FIG. 5. The blocking section 44 is pushed out of the bore 39. The blocking section 45 does not extend into the groove 41. by which the pin 38 is released. The head 38*a* of the pin 38 can be moved past the pin. operating section 45, that is, the pin 38 can. be pulled out of the bore 39. To achieve this, the transfer unit 5 moves the girder 6 in the longitudinal direction of the girder as shown in FIG. 6. Alternatively, the drive structure 17 which can engage the coupling part 36 can be activated in order to initiate the axial movement of the coupling part 36 and cause the uncoupling. In this procedure, the front surface of the pin operating section 45 slides along the surface 52 of the release plate 51.

Figure 7:
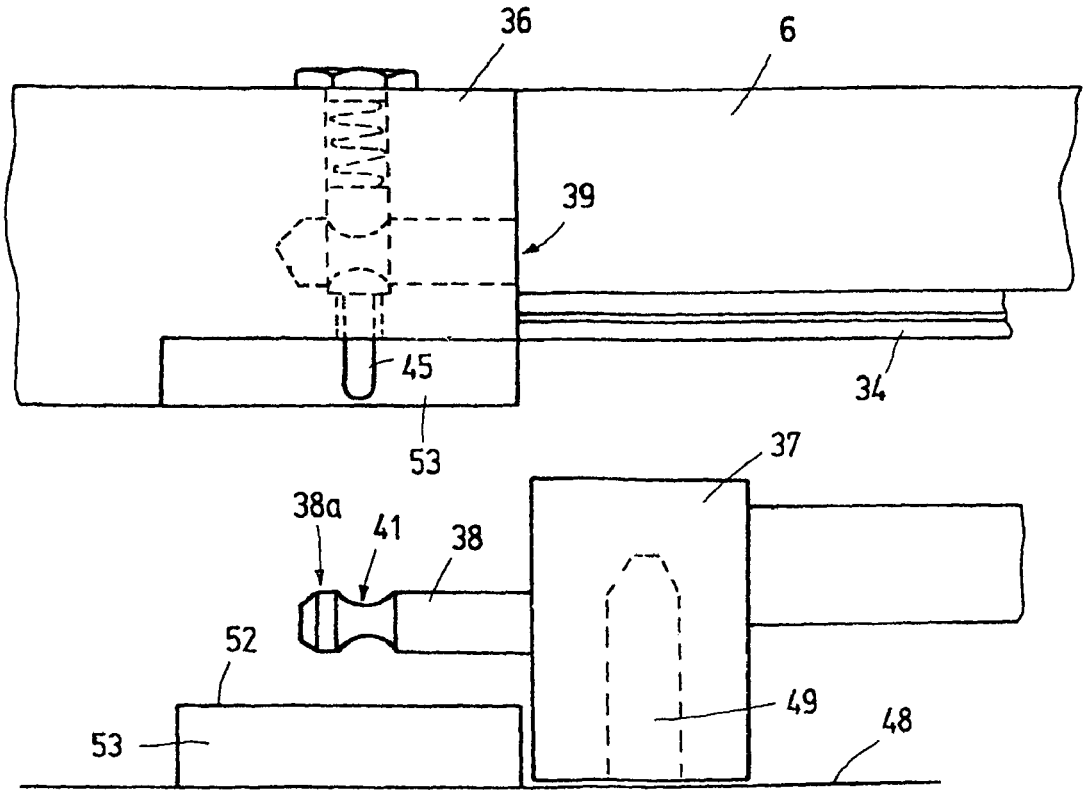
FIG. 7 shows the locking structure and the storage structure after deposition of the tooling arm on the storage structure in a partial schematic side view.

When the pin 38 has been moved out of the bore 39, the transfer unit 5 moves the girder 6 upwardly while the tooling remains disposed on the support frame 48. This state is shown in FIG. 7.

For coupling the same or another tooling, that is a suction spider 8 to the girder 6, the procedure is reversed.

For automatically changing the tooling only the already available movements capabilities along the axes of the transfer unit 5 are needed in accordance with the arrangement according to the invention. Neither active coupling structures nor active locking structures are needed or provided. A support frame 48 includes one or more indexing bolts 49 for guiding and fixing the tooling and one or several release plates 51 for unlocking the locking structure 40. The locking structure 40 may also be formed by a locking bore whose bore intersects a reception bore for a coupling pin 38. The locking bolt 40 is pre-tensioned into its locking portion and can be moved to the release portion when its narrow operating section 45 abuts the release plate 51. The release movement for actuating the locking bolt 42 is transverse to the girder 6 whereas the coupling and uncoupling movement is parallel to the girder 6.

The coupling arrangement 31 preferably includes fluid couplings which are oriented parallel to the coupling bolts or pins 38 serve as vacuum or air pressure transmitters to the suction spider. If necessary, additional media couplings may be provided. Furthermore, electrical couplings for current transfer or for the transmission of control signals and/or information signals for the sensors or for the activators may be provided. In addition, couplings for information covers, such as light conductors, may be provided wherein the coupling and uncoupling direction is always in the longitudinal direction of the girder 6 or, respectively, the longitudinal direction of the pin 38. Such a coupling arrangement 54 is shown in FIG. 3 schematically by dashed lines.

What is claimed is:

1. A workpiece gripper arrangement for the automatization of presses, particularly for large component stage presses, comprising:

a transfer arrangement (4) including a girder (6) moveably supported by a drive arrangement (16) for operating the transfer arrangement, gripper means (7) supported by the girder (6) for the controlled gripping and releasing the components, a coupling arrangement (31) including two coupling parts (36, 37) of which one is connected with the girder (6) and the other with the gripper means (7), the coupling part (37) associated with the gripper means (7) includes an arresting structure (47, 49) by way of which the gripper means (7) is engaged on a support frame (48), the arresting structure (47, 49) is engageable by a linear relative movement between the gripper means (7) and the support frame (48) in a direction transverse to the longitudinal length of the girder (6), the drive arrangement (16) includes adjusting drive (17) in operative arrangement with the gripper means (7) for longitudinal movement of the gripper means (7) along the girder (6), the coupling arrangement (31) comprising a mechanical locking structure (40) including an operating pin section (45) which is operable in a direction transverse to the longitudinal length of the girder (6) by a linear relative movement of the coupling arrangement (31) with respect to a stop member (51) which transfers the locking structure (40) to a release position when activated by the stop member (51) operatively engaging pin section (45).

2. The workpiece gripper arrangement for the automatization of presses, particularly for large component state presses, comprising:

a transfer arrangement (4) including a girder (6) moveably supported by a drive arrangement (16) for operating the transfer arrangement, gripper means (7) supported by the girder (6) for the controlled gripping and releasing the components, a coupling arrangement (31) including two coupling parts (36, 37) of which one is connected with the girder (6) and the other with the gripper means (7), the drive arrangement (16) includes adjusting drive (17) in operative arrangement with the gripper means (7) for longitudinal movement of the gripper means (7) along the girder (6), the coupling arrangement (31) comprising a mechanical locking structure (40) including an operating pin section (45) which is operable in a direction transverse to the longitudinal length of the girder (6) by a linear relative movement of the coupling arrangement (31) with respect to a stop member (51) which transfers the locking structure (40) to a release position when activated by the stop member (51) operatively engaging pin section (45), one of the coupling parts (36, 37) includes a pin (38) with a groove (41) forming a locking groove, the other of the coupling parts (37, 36) includes a locking bolt (42) forming a locking structure (40) with the pin (38), the locking bolt (42) is operably movable and extends transverse to the direction of the engagement and disengagement movement of the coupling arrangement (31), the locking bolt (42) comprises a blocking section (44) which, in the locking position of the locking bolt (42) is received in the groove (41) of the pin (38) with little play, the locking bolt (42) includes the operating pin section (45) which has a smaller diameter than the blocking section (44) of the locking bolt (42) so that it does not protrude into the groove (41) when stop member (51) operatively engages pin section (45) in the release position of the locking structure (40).

* * * * *